US005623952A

United States Patent [19]

Häusler

[11] Patent Number: 5,623,952

[45] Date of Patent: Apr. 29, 1997

[54] METHOD AND APPARATUS FOR MAKING FILTER CIGARETTES

[75] Inventor: Nikolaus Häusler, Wohltorf, Germany

[73] Assignee: Hauni Maschinenbau GmbH, Hamburg, Germany

[21] Appl. No.: 589,395

[22] Filed: Jan. 22, 1996

[30] Foreign Application Priority Data

Feb. 1, 1995 [DE] Germany ..... 195 03 123.7

[51] Int. Cl.[6] ..... A24C 5/60

[52] U.S. Cl. ..... 131/281; 131/365; 131/361

[58] Field of Search ..... 131/281, 282, 131/365, 94, 84.4

[56] References Cited

U.S. PATENT DOCUMENTS

| | | | |
|---|---|---|---|
| 2,218,674 | 10/1940 | Eaton | 164/99 |
| 3,583,546 | 6/1971 | Koop | 131/281 |
| 3,625,103 | 12/1971 | Giatti | 131/281 |
| 3,683,559 | 8/1972 | Kalwaites | 51/74 |
| 4,193,409 | 3/1980 | Wahle | 131/23 R |
| 4,240,448 | 12/1980 | Heitmann | 131/21 R |
| 4,323,082 | 4/1982 | Helms et al. | 131/281 |
| 4,370,942 | 2/1983 | Dowding | 118/40 |
| 4,825,883 | 5/1989 | Hinz et al. | 131/281 |
| 5,135,008 | 8/1992 | Oesterling et al. | 131/281 |

FOREIGN PATENT DOCUMENTS

| | | | |
|---|---|---|---|
| 2222963 | 10/1974 | France | 131/281 |
| 194021 | 9/1907 | Germany | 131/281 |
| 75989 | 5/1977 | Luxembourg | 131/281 |
| 2137068 | 10/1984 | United Kingdom | 131/281 |

*Primary Examiner*—Vincent Millin
*Assistant Examiner*—Charles W. Anderson
*Attorney, Agent, or Firm*—Darby & Darby

[57] ABSTRACT

The web of tipping paper which is being advanced in a filter tipping machine from a source to the station where the web is subdivided into uniting bands ready for draping around groups of coaxial plain cigarettes and filter rod sections is provided with projecting portions which are at least partially removed by a rotary grinding tool to provide the web with a pattern of perforations which determine the degree of ventilation of the filter cigarettes. The position of the running web relative to the tool and/or vice versa is adjustable in dependency upon one or more parameters of the finished filter cigarettes to thus vary the permeability of the uniting bands when the one or more monitored parameters of the filter cigarettes depart from the desired values.

27 Claims, 3 Drawing Sheets

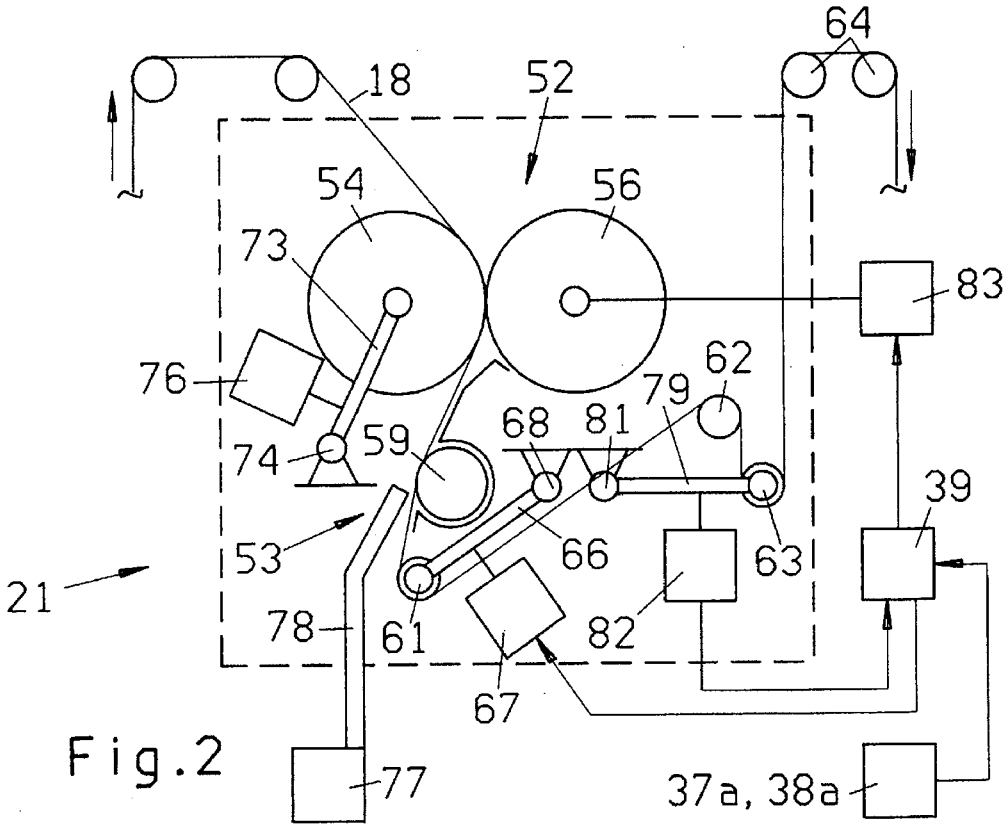
Fig.2
Fig.4
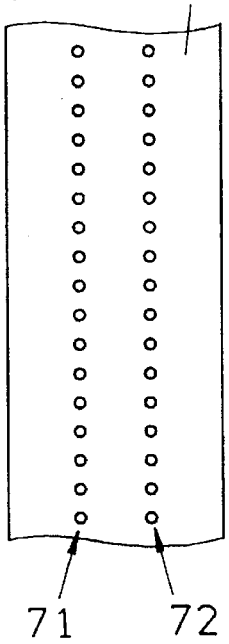
Fig.5
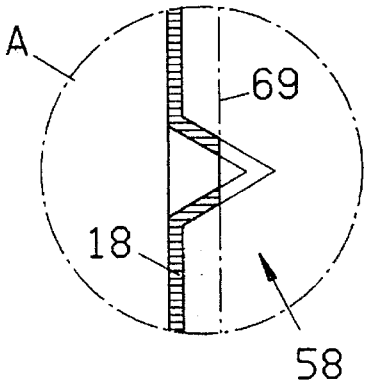

METHOD AND APPARATUS FOR MAKING FILTER CIGARETTES

BACKGROUND OF THE INVENTION

The invention relates to improvements in methods of and in apparatus for making rod-shaped smokers' products of the type wherein a tobacco-containing section is attached to one end of a filter material containing section by an adhesive-carrying uniting band. A large majority of such smokers' products constitute (and will hereinafter be referred to as) filter cigarettes.

Apparatus which are presently utilized for the mass production of filter cigarettes are known as filter tipping machines or filter assemblers. Well known types of such machines are MAX 70, MAX 90, MAX 100 and MAX-S filter assemblers which are produced and distributed by the assignee of the present application. Such machines are normally assembled with plain cigarette makers and filter rod makers into production lines (e.g., those known as PROTOS 2, PROTOS 70, PROTOS 90 and PROTOS 100, all produced and distributed by the assignee of the present application) which are capable of turning out huge quantities of filter cigarettes per unit of time.

A MAX filter assembler is designed to transport a continuous series of successive groups of coaxial plain cigarettes and filter rod sections sideways, i.e., transversely of the longitudinal axes of such groups. Each group can contain plain cigarettes of single or multiple (e.g., double) unit length and a corresponding number of filter rod sections of unit length or multiple unit length. It is presently preferred to assemble groups wherein a filter rod section of double unit length is flanked by two plain cigarettes of unit length. Successive groups of the series are provided with adhesive-carrying uniting bands made of so-called tipping paper, and the bands are convoluted around the filter rod sections of double unit length as well as around the adjacent portions of the plain cigarettes to convert each group into a filter cigarette of double unit length. Each such filter cigarette of double unit length is thereupon severed midway across its filter rod section of double unit length to yield a pair of filter cigarettes of unit length. The uniting bands are obtained by advancing a continuous web of tipping paper (e.g., imitation cork) from a bobbin, reel or another suitable source, first past an adhesive applying station and thereupon past a severing or subdividing station wherein the leader of the web is subdivided into a series of successive uniting bands ready to be draped around selected portions of successive groups of rod-shaped tobacco containing and filter material containing sections.

It is also known to employ apparatus of the above outlined character for the making of so-called ventilated filter cigarettes having tubular wrappers which permit cool atmospheric air to penetrate into the column of tobacco smoke flowing from the lighted end of the filter cigarette into a smoker's mouth. The inflowing atmospheric air is to reduce condensate and nicotine contents of tobacco smoke, i.e., to produce a diluting effect upon tobacco smoke.

Heretofore known procedures for the making of ventilated filter cigarettes include the making of perforations in the tubular wrappers of filter cigarettes of unit length or multiple unit length or the utilization of preperforated tipping paper. The tubular wrappers of the filter rod sections and the filter material of such sections must exhibit an adequate permeability to the inflow of air if the ventilated filter cigarettes are to be provided with convoluted uniting bands made of preperforated tipping paper. A drawback of apparatus which produce ventilated filter cigarettes by using off-line perforated tipping paper is that it is not possible to immediately influence the permeability of the wrappers of filter cigarettes if the testing of ventilated cigarettes downstream of the station for the application of uniting bands made of preperforated tipping paper indicates that the actual permeability is insufficient or excessive. The testing can involve a determination of the so-called draw resistance of filter cigarettes or directly the rate of inflow of air into their filter mouthpieces.

Commonly owned U.S. Pat. No. 4,825,883 (granted May 2, 1989 to Hinz et al. for "Method of and machine for making filter cigarettes from pairs of plain cigarettes of double unit length") discloses an apparatus wherein the ventilating unit includes a device for making perforations in the tubular wrappers of filter cigarettes of multiple unit length or in the web of tipping paper upstream of the location where the leader of the wed is subdivided into discrete uniting bands. The details of the device which is to perforate the web of tipping paper are not disclosed; in fact, applicant is not aware of any apparatus capable of making perforations in a running web of tipping paper in a filter cigarette maker or assembler.

OBJECTS OF THE INVENTION

An object of the invention is to provide a method of influencing the permeability of a web of tipping paper which is used in a filter cigarette assembler.

Another object of the invention is to provide a method which can be resorted to in line, i.e., while a web of tipping paper is in the process of advancing in a filter cigarette assembler toward the station where its leader is divided into a series of uniting bands ready to be applied to groups of coaxial rod-shaped articles of the tobacco processing industry.

A further object of the invention is to provide a method which renders it possible to select in advance, or to vary, the ability of a running web of tipping paper to permit the flow of atmspheric air into a column of tobacco smoke.

An additional object of the invention is to provide a novel and improved apparatus for the practice of the above outlined method.

Still another object of the invention is to provide a filter assembler which is provided with an apparatus for making perforations in a running web of tipping paper.

Another object of the invention is to provide a filter cigarette production line which embodies one or more apparatus for influencing the permeability of a running web of tipping paper serving to connect coaxial plain cigarettes and filter rod sections to each other.

A further object of the invention is to provide an adjustable apparatus for influencing the permeability of a running web of tipping paper in a filter cigarette maker.

An additional object of the invention is to provide the apparatus with novel and improved means for determining the locations and/or the size of perforations to be made in a running web of tipping paper.

Still another object of the invention is to provide filter cigarettes employing uniting bands made from tipping paper which has been perforated in the above outlined apparatus and in accordance with the above outlined method.

A further object of the invention is to provide a wed perforating apparatus which can be installed in existing filter tipping machines to influence the permeability of a running web of tipping paper, such as imitation cork or the like.

SUMMARY OF THE INVENTION

One feature of the present invention resides in the provision of a method of making filter cigarettes of the type wherein groups of plain cigarettes and filter rod sections are held in axial alignment by convoluted adhesive-carrying uniting bands. Each group can comprise one or more plain cigarettes and one or more filter rod sections of unit length or multiple unit length. The method comprises the steps of conveying a series of successive groups (preferably sideways) along a first path, advancing a web of coherent uniting bands from a source (such as a bobbin or reel) along a second path, displacing selected portions of the web and at least partially removing at least some of the displaced selected portions to thus provide the web with perforations the number and the dimensions of which determine the permeability of the thus treated web, subdividing the perforated web into discrete uniting bands, and convoluting the discrete uniting bands around the groups in the first path.

The removing step can include grinding and/or similarly treating the at least some displaced portions of the web in the second path.

The web is advanced along the second path in a predetermined direction and the displacing step is carried out in a first portion of the second path. The removing step can be carried out in or at the first portion of the second path; however, in accordance with a presently preferred embodiment of the improved method, the removing step is carried out in a second portion of the second path downstream of the first portion (as seen in the predetermined direction).

The conveying step includes moving the groups along the first path in a preselected direction and the convoluting step is carried out in a first portion of the first path. The method can further comprise the steps of monitoring at least one variable parameter of the groups in a second portion of the first path downstream of the first portion (as seen in the preselected direction), generating signals denoting the at least one parameter of the groups, and utilizing the signals for regulation of the removing step so that the permeability of uniting bands varies as a function of variations of the at least one parameter. For example, the at least one parameter can constitute the permeability of tubular wrappers of groups of plain cigarettes and filter rod sections downstram of the locus of the convoluting step. The utilizing step can include regulating the removing step so that the at least one variable parameter at least approximates a predetermined value; for example, the permeability of the tubular wrappers of the groups downstream of the locus of the convoluting step can be maintained at or close to a predetermined value by the expedient of regulating the removing step, e.g., by increasing the number and/or the dimensions of the perforations.

Another feature of the invention resides in the provision of an apparatus for making filter cigarettes wherein groups of plain cigarettes and filter rod sections are held in axial alignment by convoluted adhesive-carrying uniting bands. The improved apparatus comprises means for conveying a series of successive groups along a first path, means for advancing a web of coherent uniting bands from a source along a second path, means for displacing selected portions of the advancing web relative to the second path, means for at least partially removing material from at least some of the displaced selected portions to thus provide the web with perforations which determine the permeability of the web, means for subdividing the perforated web into discrete uniting bands, and means for convoluting the discrete uniting bands around the groups in the first path.

The displacing means can include a rotary displacing member having a surface which is adjacent a predetermined portion of the second path and projections extending from such surface and into the web in the predetermined portion of the second path. The aforementioned surface can constitute a peripheral surface of the rotary displacing member and the projections can be arrayed to jointly form a predetermined pattern of web displacing portions on the peripheral surface of the rotary displacing member. The displacing means can further comprise means for biasing the web against the projections; the rotary displacing member and the biasing means are or can be disposed at opposite sides of the second path. The biasing means can comprise a second rotary member having a resilient web-contacting radially outer portion of rubber or other suitable elastomeric material.

The removing means can comprise a grinding device or an analogous material removing tool. The advancing means can include means for moving the web along the second path in a predetermined direction and the displacing means is adjacent a first portion of the second path. In accordance with a presently preferred embodiment, the removing means is adjacent a second portion of the second path downstream of the first portion (as seen in the predetermined direction). The grinding device can include a material removing tool which contacts at least the at least some displaced selected portions of the web in the second portion of the second path.

The material removing means is or can be adjustable, and such apparatus can further comprise means for adjusting the removing means and/or the web in the second path relative to each other to thus select the extent of material removal at least from the at least some displaced selected portions of the running web. The adjusting means includes or can include suitable signal processing means. The conveying means can comprise means for moving the groups along the first path in a predetermined direction past and beyond the convoluting means and such apparatus can further comprise means for monitoring at least one variable parameter of the groups downstream of the convoluting means (as seen in the predetermined direction) and for generating signals which denote the monitored parameters of successive groups. Still further, this apparatus can comprise means (such as the aforementioned signal processing means) for influencing the adjusting means in response to the signals from the monitoring means. The influencing means can be designed in such a way that it maintains the at least one variable parameter at least close to a predetermined value by way of the adjusting means. The at least one parameter can constitute the permeability of tubular wrappers forming part of the groups downstream of the convoluting means. The removing means can include the aforementioned grinding or other suitable material removing tool, and the means for advancing the web along the second path can include means for looping the web around the tool to a variable extent to thus determine the extent of material removal at least from the at least some displaced selected portions of the web. Such apparatus can further comprise means for adjusting the looping means. For example, the looping means can comprise an adjustable roller and the adjusting means can embody means for moving the at least one roller and the tool relative to the other of the roller and the tool. The web is trained over the roller. It is presently preferred to employ adjusting means which is designed to move the roller relative to the tool and to thus vary the area of contact between the web and the tool.

The removing means can include adjustable means (such as the aforementioned biasing means) for varying the tension of the web in the second path, means for monitoring the tension of the web in the second path, and means for adjusting the tension varying means when the monitored tension departs from a predetermined value. The tension varying (biasing) means can comprise a rotary member having a peripheral web-engaging surface, and the adjusting means can include means for varying the rotational speed of such rotary member.

Still further, the apparatus can comprise means for evacuating the material which is being removed at least from the at least some displaced selected portions of the running web. For example, the evacuating means can comprise a fluid-operated evacuating device such as a vacuum cleaner.

The novel features which are considered as characteristic of the invention are set forth in particular in the appended claims. The improved filter cigarette making apparatus itself, however, both as to its construction and its mode of operation, together with numerous additional features and advantages thereof, will be best understood upon perusal of the following detailed description of certain presently preferred specific embodiments with reference to the accompanying drawings.

BRIEF DESCRIPTION OF THE DRAWINGS

FIG. 2 is an enlarged schematic front elevational view of the web perforating unit in the apparatus of FIG. 1;

FIG. 4 is an enlarged fragmentary plan view of a web of tipping paper which has been treated in accordance with the method and in the apparatus of the present invention; and FIG. 5 is a greatly enlarged view of a detail within the phantom-line circle A in FIG. 3.

DESCRIPTION OF PREFERRED EMBODIMENTS

Figure 1:
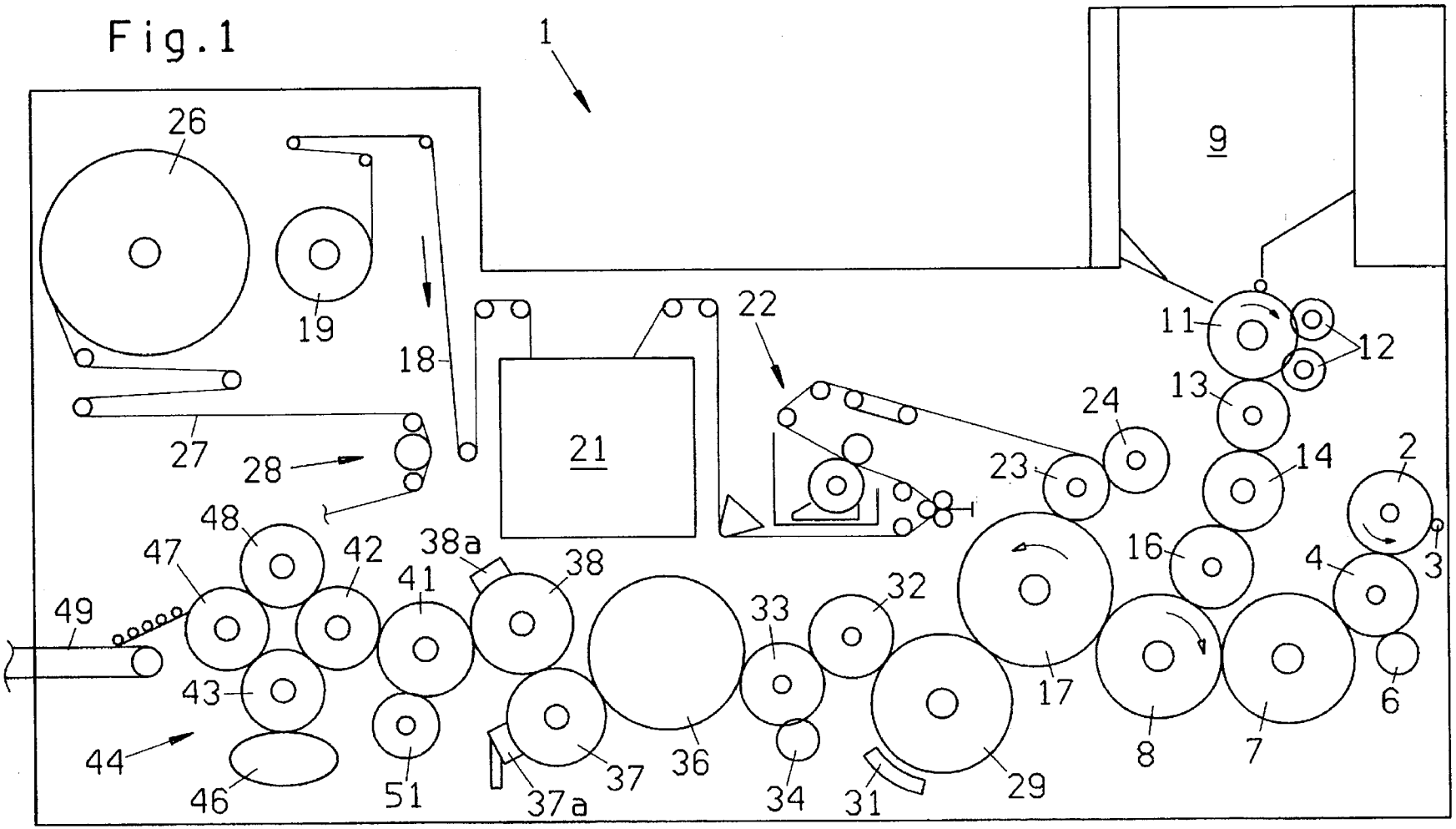
FIG. 1 is a schematic front elevational view of an apparatus, known as filter tipping machine, which embodies one presently preferred form of the invention.

FIG. 1 shows a portion of an apparatus 1 which is a filter cigarette assembler (also called filter tipping machine) and is designed to assemble plain cigarettes, filter rod sections and adhesive-carrying discrete uniting bands into filter cigarettes of unit length or multiple unit length. The apparatus of FIG. 1 is similar to that disclosed in the aforementioned commonly owned U.S. Pat. No. 4,825,883 to Hinz et al. as well as to that disclosed in commonly owned U.S. Pat. No. 5,135,005 granted Aug. 4, 1992 to Oesterling et al. for "Method of and apparatus for making filter cigarettes". The disclosures of these patents, as well as of all other patents mentioned in this specification, are incorporated herein by reference.

The apparatus 1 of FIG. 1 comprises a drum-shaped transfer conveyor 2 which receives plain cigarettes 3 of double unit length from a suitable maker (not shown), such as a cigarette making machine utilized in one of the aforementioned production lines known as PROTOS. The conveyor 2 advances a series of successive equidistant plain cigarettes 3 sideways (i.e., at least substantially at right angles to their longitudinal axes) in a predetermined or preselected direction (as indicated by the arrow) into the peripheral flutes of a rotary drum-shaped cutting or severing conveyor 4 cooperating with a rotary circular knife 6 to subdivide each plain cigarette 3 of double unit length into two coaxial plain cigarettes of unit length. Successive pairs of coaxial plain cigarettes of unit length are transferred into the axially parallel flutes in the peripheral surface of a rotary drum-shaped spreading conveyor 7 which cooperates with a stationary spreading cam or cooperates with or embodies other suitable means for moving the pairs of coaxial plain cigarettes of unit length axially and away from each other so that the thus separated pairs of plain cigarettes define clearances or gaps wide or long enough to receive filter rod sections of double unit length. The spreading conveyor 7 delivers successive pairs of axially spaced apart plain cigarettes of unit length into successive flutes in the peripheral surface of a rotary drum-shaped assembly conveyor 8 which is driven to rotate in a clockwise direction as viewed in FIG. 1.

The frame of the apparatus 1 carries a magazine 9 for a supply of parallel filter rod sections (not specifically shown) of six times unit length. Such filter rod sections can be supplied by a filter rod production line known as AF2/KDF2 or AF3E/KDF3e (both produced and distributed by the assignee of the present application). The outlet of the magazine 9 admits filter rod sections of six times unit length into the flutes of a rotary drum-shaped severing conveyor 11 which cooperates with two axially and circumferentially spaced-apart rotary disc-shaped knives 12 to subdivide each filter rod section of six times unit length into three coaxial filter rod sections of double unit length. The severing conveyor 11 delivers sets of three coaxial filter rod sections each to a staggering conveyor 13 which staggers the filter rod sections of each set in a circumferential direction and delivers discrete filter rod sections of double unit length into successive flutes of a rotary drum-shaped shuffling conveyor 14 whereon at least some of the filter rod sections are caused to move axially in order to jointly form a single file or row of filter rod sections which are located one behind the other and move sideways toward and into the axially parallel peripheral flutes of a rotary drum-shaped accelerating conveyor 16. The latter introduces discrete filter rod sections of double unit length into the aforementioned spaces between successive pairs of coaxial plain cigarettes of unit length on the assembly conveyor 8 so that the latter accumulates groups of three coaxial rod-shaped articles each, namely two axially spaced apart plain cigarettes of unit length and a filter rod section of double unit length between them. The assembly conveyor 8 cooperates with stationary cams or with other suitable means for moving the plain cigarettes of successive groups axially and toward each other and into abutment with the adjacent end faces of the respective filter rod sections of double unit length so that the overall length of each thus condensed group matches the combined axial length of two plain cigarettes of unit length and a filter rod section of double unit length. The assembly conveyor 8 delivers such condensed groups of coaxial rod-shaped sections into successive flutes of a rotary drum-shaped transfer conveyor 17 which is driven to rotate in a counterclockwise direction (as viewed in FIG. 1). The conveyor 17 defines that portion of a (first) path for groups of coaxial rod-shaped sections in which successive groups receive and entrain discrete adhesive-carrying uniting bands constituting portions of a continuous web 18 of tipping paper (e.g., imitation cork or the like).

Figure 3:
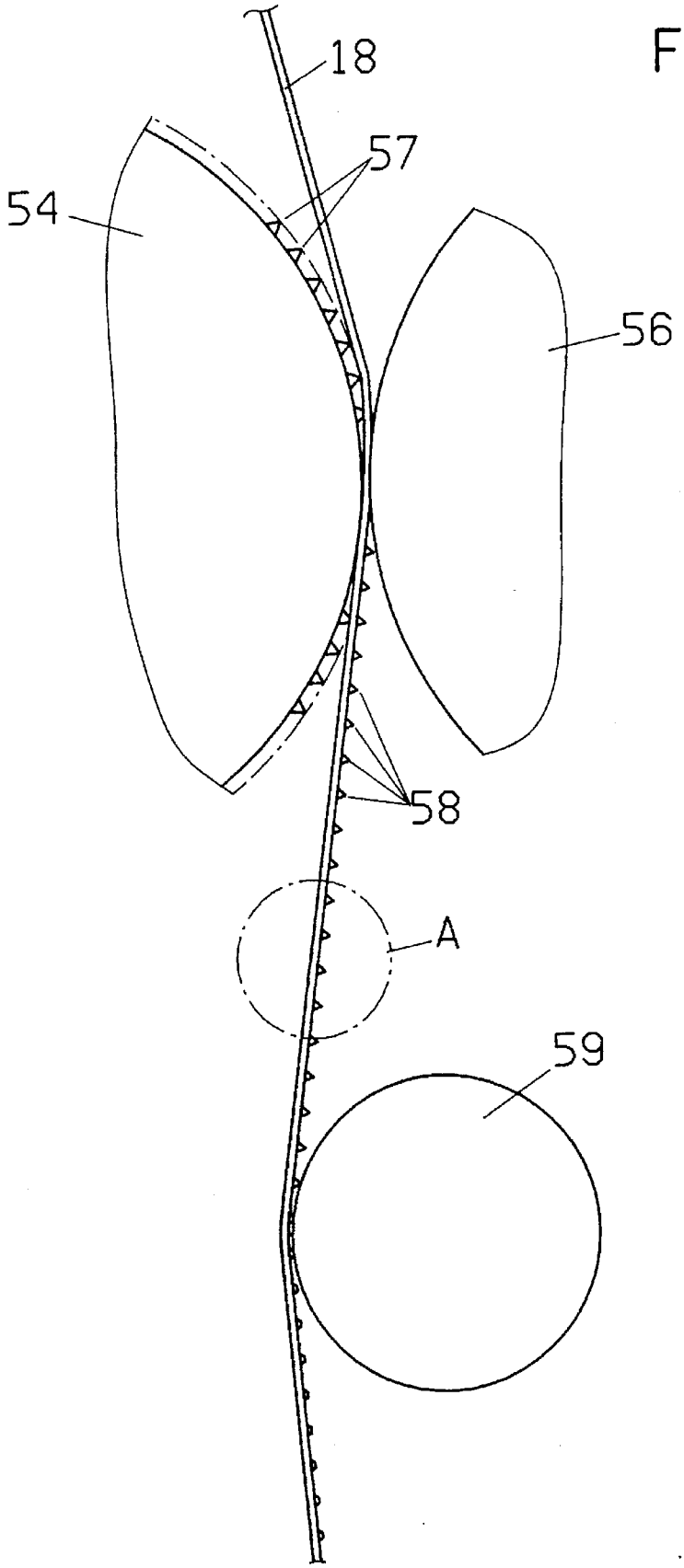
FIG. 3 is a greatly enlarged view of a detail in the structure of FIG. 2.

The web 18 is being drawn from a suitable source here shown as an expiring reel 19 carrying a supply of convoluted tipping paper and being removably mounted in the frame of the filter cigarette making apparatus 1. In accordance with the invention, successive increments of the web running along its (second) path from the source 19 toward the transfer conveyor 17 are caused to advance through a novel and improved in-line perforating or permeability influencing unit 21 the details of which are illustrated in FIGS. 2, 3 and 5. The thus perforated increments of the web 18 are thereupon caused to advance through a device 22 wherein selected portions of one side of the web are provided with films of a suitable adhesive in a manner well known in the art and not specifically shown in FIG. 1. The means for advancing the web 18 along its (second) path includes certain components of the perforating unit 21 and a rotary drum-shaped suction conveyor 23 cooperating with a rotary cylindrical cutter 24 to subdivide the leader of the adhesive-carrying and properly perforated web 18 into a series of discrete uniting bands ready to be affixed to successive groups of axially aligned rod-shaped sections being transported by the transfer conveyor 17 in a direction from the assembly conveyor 8 toward a convoluting or rolling station including a further rotary drum-shaped conveyor 29 forming part of the means for conveying the groups of axially aligned rod-shaped sections along their (first) path.

A fresh reel 26 containing a web 27 of tipping paper is mounted in the frame of the filter cigarette making apparatus 1 adjacent the expiring reel 19. The leader of the web 27 is threaded through a splicer 28 which automatically attaches such leader to the web 18 when the supply of web on the reel 19 is about to expire.

The transfer conveyor 17 delivers successive groups of rod-haped sections, each of which carries an adhesive-carrying uniting band, to the convoluting station including the aforementioned conveyor 29 and a rolling member 31. The parts 29 and 31 cooperate to roll the uniting bands around the respective filter rod sections of double unit length and around the adjacent inner end portions of the respective plain cigarettes of unit length to thus convert each group into a filter cigarette of double unit length. Such cigarettes of double unit length are taken over by a rotary drum-shaped transfer conveyor 32 which delivers them into the peripheral flutes of a rotary drum-shaped severing conveyor 33. The latter cooperates with a rotary disc-shaped knife 34 which severs each filter cigarette of double unit length midway between its ends so that each such cigarette yields two filter cigarettes of unit length having filter mouthpieces of unit length adjacent one another. The thus obtained pairs of coaxial filter cigarettes of unit length are transferred onto a further rotary drum-shaped conveyor 36 on which at least one of the two filter cigarettes of each pair is moved axially and away from the other filter cigarette to establish between them a gap of predetermined width or of a width exceeding a predetermined minimum width.

The conveyor 36 delivers successive pairs of axially spaced-apart filter cigarettes of unit length onto a first rotary drum-shaped testing conveyor 37 which, in turn, transfers such pairs onto a second rotary drum-shaped testing conveyor 38. The conveyor 37 transports pairs of filter cigarettes past a first signal generating monitoring device **37*a* which can be designed to generate signals denoting at least one parameter of each tested filter cigarette, for example, the density of the free axial ends of tobacco-containing sections of the filter cigarettes. The conveyor 38 transports pairs of once tested filter cigarettes of unit length past a second signal generating monitoring device 38*a* which can comprise suitable pneumatically operated means for ascertaining deviations of one or more additional parameters of filter cigarettes from predetermined optimal values. For example, the monitoring device 38*a* can be designed to ascertain the density of the wrappers of the filter cigarettes, the degree of ventilation (i.e., the rate at which atmospheric air can penetrate into a column of tobacco smoke when the respective filter cigarette is lighted), the so-called draw resistance and/or other variable parameters. The signals which are generated by the monitoring devices 37*a* and 38*a* are transmitted to a signal processing unit 39 which is shown in FIG. 2 and which can be said to form part of the aforementioned perforating or permeability influencing unit 21 for the web 18 of tipping paper. The details of the monitoring devices 37*a*, 38*a*** are known in the relevant art.

The thus repeatedly tested pairs of coaxial and axially spaced apart filter cigarettes of unit length are taken over by a rotary drum-shaped intermediate conveyor 41 which delivers them onto a rotary drum-shaped transfer conveyor 42. The latter forms part of a conventional turn-around or inverting device 44 which inverts one filter cigarette of each pair end-for-end and inserts the thus inverted cigarette between two successive non-inverted cigarettes. As shown in FIG. 1, the conveyor 42 delivers one filter cigarette of each pair onto a rotary drum-shaped conveyor 43 which cooperates with a conical inverter 46. The conveyor 42 delivers the other filter cigarette of each pair onto a rotary drum-shaped conveyor 48 which, in turn, delivers such filter cigarettes into alternate axially parallel flutes in the peripheral surface of a further conveyor 47. The other flutes of the conveyor 47 receive inverted filter cigarettes from the inverter 46 by way of the conveyor 43 so that the flutes of the conveyor 47 contain a single file of filter cigarettes of unit length having filter mouthpieces facing in the same direction. Successive filter cigarettes of such single file are delivered onto the upper reach of a take-off belt or chain conveyor 49 which delivers them to storage or directly to a packing machine, not shown.

A turn-around device 44 of the type shown in FIG. 1 (utilizing a conical inverter 46) is disclosed, for example, in U.S. Pat. No. 3,625,103 granted Dec. 7, 1971 to Giatti for "Cigarette turn around". Another suitable turn-around device is disclosed in U.S. Pat. No. 3,585,546 granted Jun. 8, 1971 to Koop for "Apparatus for inverting cigarettes or the like".

The conveyor 49 can deliver the inverted and non-inverted filter cigarettes of unit length into a path wherein the filter cigarettes form a multi-layer (mass) flow and advance toward the next processing station.

The reference character 51 denotes in FIG. 1 a further conveyor which serves to remove from the intermediate conveyor 41 those filter cigarettes which have been found to be detective by the monitoring means **37*a* and/or 38*a*. The thus removed defective filter cigarettes can be transported to a collecting receptacle for defective articles or to a station where the tobacco particles are recovered for renewed processing in a cigarette making machine. The conveyor 51 need not serve the purpose or the sole purpose of removing defective filter cigarettes. For example, in addition to or in lieu of such function, the conveyor 51 can be actuated at regular or at random intervals for withdrawal of series of filter cigarettes which are to be tested in a laboratory for the potential presence of additional defects or for testing in order to ascertain the quality of the testing action of the monitoring means 37*a* and/or 38*a***.

Save for the provision, the construction and the mode of operation of the perforating unit 21, the structure which is shown in FIG. 1 can constitute or form part of one of the aforementioned MAX filter tipping machines being produced and distributed by the assignee of the present application.

The unit 21 comprises a device 52 which serves to displace selected portions (shown at 58 in FIG. 3) of the running web 18 from its path between the reel 19 and the adhesive applying device 22, and a device 53 which serves to remove at least certain parts of at least some of the selected portions 58 to thus provide the web with an array of perforations (such as the array of perforations 71, 72 shown in FIG. 4) which determine the permeability of the thus treated web 18 upstream of the location (at the suction conveyor 23) where the leader of the web is severed by the knives of the rotary cutter 24 to yield a succession of discrete adhesive-carrying uniting bands ready to be affixed to the groups advancing with the transfer conveyor 17.

The device 52 of the unit 21 which is shown in FIGS. 2, 3 and 5 comprises a rotary drum-shaped or roller-shaped displacing member 54 having a cylindrical peripheral surface provided with an array of suitably distributed raised portions 57 together constituting a pattern of projections which displace the selected portions 58 of the running web 18 from the general plane of such web, e.g., in a manner as best shown in FIG. 5. The illustrated projections 57 of the member 54 can constitute conical or pyramidal protuberances which cause the adjacent portions of the running web 18 to penetrate into the elastically yieldable radially outermost portion or layer of a second rotary member 56 forming part of the displacing device 52. The rotary menders 54 and 56 confront each other and are located at opposite sides of the (second) path for the advancement of the web 18 from the reel 19 toward the adhesive applying device 22. The radially outermost portion of the rotary member 56 can constitute a layer of rubber or a suitable elastomeric synthetic plastic material.

The dimensions, the number and/or the distribution of the projections 57 will depend upon the desired permeability of the web 18, and such permeability is a function of the material removing action of the removing device 53 which is located downstream of the device 52, as seen in the direction of advancement of the web 18 through the unit 21. For example, the illustrated conical projections 57 can be replaced by or used jointly with cubical and/or trapezoidal projections having a square, rectangular or other suitable outline. The deformed portion 58 which is shown in FIG. 5 has been drawn to a greatly enlarged scale for the sake of clarity. In actual practice, the deformed portions 58 are or can be so small that they are hardly detectable or not detectable by the naked eye.

The illustrated device 53 comprises a rotary material removing tool 59, e.g., a grinding wheel or an equivalent of a grinding wheel which can be positioned to remove portions of or the entire projections 58 on the adjacent increments of the advancing web 18. FIG. 5 shows one possible position of the severing plane 69 of the rotary tool 58; the position of this plane is selected in such a way that the tool 59 removes the tip of the hollow conical projection 58 which is caused to move past and beyond the device 53. This provides the projection 58 with a centrally located round hole or perforation having a predetermined diameter.

The unit 21 further comprises an adjustable guide roller 61 which is located downstream of the tool 59 and can be moved to any one of a plurality of different positions in each of which the peripheral surface of the tool 59 contacts a different portion of the running web 18. From the guide roller 61, the path for the web 18 extends toward and partially around a deflecting roller 62, thereupon around an adjustable floating or dancer roller 63, and thereafter over additional deflecting rollers 64 which direct the web toward the adhesive applying device 22.

The means for adjusting the guide roller 61 relative to the material removing tool 59 comprises a lever 66 which is turnable about the axis of a shaft 68 under the action of a prime mover 67 connected to an output of the signal processing unit 39. As mentioned above, pivoting of the guide roller 61 about the axis of the shaft 68 entails a change in the area of contact between the running web 18 and the peripheral surface of the material removing tool 59, i.e., the signal processing unit 39 can cooperate with the prime mover 67 (e.g., a reversible electric motor) to select the extent of the material removing action of the tool 59 upon some or all of the deformed portions 58 of the web 18.

An advantage of conical or pyramidal projections 57 and deformed portions 58 is that the dimensions of the perforations in the deformed portions 58 can be varied in response to relative movement between the severing or material removing plane 69 (FIG. 5) of the tool 59 and the path for the web 18. The path for the web 18 moves closer to the severing plane 69 if the guide roller 61 is pivoted in a counterclockwise direction as viewed in FIG. 2. This results in the making of larger perforations or holes in the displaced portions 58 of the web 18. Inversely, the diameters of the perforations in the displaced portions 58 are reduced if the signals from the signal processing unit 39 induce the prime mover 67 to pivot the lever 66 and the guide roller 61 in a clockwise direction. Since the unit 39 receives signals from the signal generating means 37*a*, 38*a* which monitor the parameters of the groups of rod-shaped sections downstream of the convoluting station (at 29, 31), the unit 21 is capable of selecting the permeability of the uniting bands as a function of the extent of deviation of one or more parameters of the finished products (filter cigarettes) from a desired or optimum value. For example, the arrangement can be such that the signal processing unit 39 induces the prime mover 67 to change the position of the guide roller 61 relative to the material removing tool 59 in a manner to ensure that the permeability of the wrappers of finished filter cigarettes to the flow of air into their interior will at least approximate a desired value. Alternatively or in addition to adjustment in dependency upon changes of the permeability of wrappers of finished filter cigarettes, the unit 39 can be designed to transmit to the prime mover 67 signals which are necessary to ensure that the so-called draw resistance of the filter mouthpieces of finished filter cigarettes will at least approximate a desired or optimum resistance.

It will be appreciated that the array of perforations 71, 72 shown in FIG. 4 is but one of the practically infinite number of different formations or patterns which can be obtained by resorting to the unit 21 of FIGS. 2, 3 or an equivalent or analogous unit. Furthermore, and as already mentioned before, it is possible to provide the peripheral surface of the rotary displacing member 54 with projections having a configuration other than a conical or pyramidal shape. Still further, it is possible to provide the member 54 with two or more sets of projections having different sizes and/or shapes.

FIG. 2 shows that the shaft for the displacing member 54 is mounted on at least one lever or arm 73 which is pivotable about the axis of a fixed shaft 74. The means for changing the angular position of the lever 73 (and for thus changing the magnitude of force with which the projections 57 are urged into the material of the running web 18) includes a preferably adjustable device 76, e.g., a hydraulically or pneumatically operated cylinder and piston assembly. The latter can further serve as a means for moving the displacing member 54 away from the rotary member 56, e.g., to replace the member 54 with a member having a different array of projections 57 or a different number of projections and/or to replace the rotary member 56 with an intact member or with a member having a peripheral layer exhibiting a different resistance to deformation by the projections 57 or other types of web deforming protuberances.

FIG. 2 further shows that the unit 21 can be provided or combined with a material evacuating device 77 (e.g., a fluid-operated evacuating device such as a vacuum cleaner) which has an intake at the region of contact between the running web 18 and the material removing tool 59 to collect and withdraw the material which is being removed from the displaced portions 58 when the unit 21 is in use. The reference character 78 denotes a flexible or rigid conduit which forms part of the evacuating device 77 and establishes a path for withdrawal of removed material from the station including the material removing tool 59.

The floating roller or dancer roller 63 is mounted on a lever or arm 79 which is pivotable about the axis of a fixed shaft 81. The latter is mounted in the frame of the filter cigarette making apparatus, the same as the shafts 68 and 74. The position (i.e., the level) of the roller 63 is indicative of the tensional stress upon the running web 18, and such position is monitored by a sensor 82 which is operatively connected to the lever 79 and transmits corresponding signals (denoting the tensional stress upon the web 18) to the signal processing unit 39. The latter cooperates with a servomotor 83 to constitute a means for adjusting the RPM of the pressure applying rotary member 56 and more specifically the peripheral speed of the member 59. If the floating roller 63 descends to lower level, this indicates that the tensional stress upon the web 18 is reduced. The signal processing unit 39 then cooperates with the servomotor 83 to reduce the peripheral speed of the rotary member 56 accordingly. Inversely, the peripheral speed of the rotary member 56 is increased by the adjusting means 39, 83 when the floating roller 63 rises to a higher level because this indicates that the tensional stress upon the running web 18 has been increased. An advantage of adjustability of the peripheral speed of the rotary member 56 is that the unit 21 can establish more satisfactory and more predictable conditions for the making of perforations by the material removing tool 59. In other words, such adjustment of the tensional stress upon the web 18 can enhance the quality of the filter cigarettes which are being delivered to the take-off conveyor 49.

An important advantage of the improved method and apparatus is that they can be resorted to in order to provide uniting bands exhibiting the desired permeability to the inflow of atmospheric air into the filter mouthpieces of the filter cigarettes in a relatively simple and inexpensive way. In addition, it is possible to select the pattern of perforations not only for the purpose of ensuring adequate ventilation but also to avoid detection of perforations (e.g., by increasing their number) or by selecting for the perforations an eye-pleasing pattern.

Another important advantage of the improved method and apparatus is that, by resorting to a grinding or an analogous material removing tool, one can select the degree of ventilation with a very high degree of accuracy and it is further possible to vary the rate of flow of air into the filter mouthpieces in a simple but highly predictable manner.

Though it is possible to place the material removing tool 59 directly opposite the rotary displacing member 54 (i.e., to cause the tool 59 to occupy the position occupied in FIGS. 2 and 3 by the rotary member 56), the positioning of the tol 59 downstream of the material displacing member 54 brings about the important advantage that the projections 57 are subject to less pronounced wear or no wear at all which, in turn, ensures that the member 54 can provide the running web 18 with a pattern of deformed portions 58 having an optimum size and shape for a long period of time.

An advantage of the feature that the signal processing unit 39 can receive signals from monitoring means 37*a*, 38*a* which are adjacent the path of finished filter cigarettes is that the characteristics of finished filter cigarettes can be readily and practically instantaneously influenced as soon as the need arises, i.e., as soon as the monitoring means 37*a* and/or 38*a* indicates that one or more monitored characteristics of the finished products depart from the desired optimum characteristics or from a range of acceptable characteristics.

Practically instantaneous influencing of permeability of the uniting bands is made possible by installing the unit 21 in the filter cigarette making apparatus 1, i.e., the unit 21 can achieve in line influencing of permeability of the web 18 which is running from the source 19 toward the convoluting station at 29, 31.

The improved method and apparatus are susceptible of numerous additional modifications without departing from the spirit of the invention. For example, the permeability of the web 18 can be monitored immediately downstream of the tool 59 and the material removing action of this tool can be altered as soon as the monitored permeability departs from a desired range of acceptable values.

It has been found that the improved method and apparatus can be resorted to for the making of perforations in a web which is being advanced along its path at a speed necessary in modern high-speed filter cigarette making apparatus which are capable of turning out huge quantities of such products per unit of time. Moreover, the apparatus can be installed in existing types of filter tipping machines and/or production lines employing available filter cigarette assemblers. Still further, the utilization of mechanical material removing means contributes significantly to the simplicity, compactness and lower cost of the unit 21 and of the apparatus which employs such unit. However, it is also within the scope of the invention to provide the unit 21 with material removing means other than one or more grinding tools or the like or to employ mechanical as well as other suitable material removing means.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A method of making filter cigarettes wherein groups of plain cigarettes and filter rod sections are held in axial alignment by convoluted adhesive-carrying uniting bands, comprising the steps of conveying a series of successive groups along a first path; advancing a web of coherent uniting bands from a source along a second path; mechanically displacing selected portions of the web and at least partially removing by mechanical means at least some of the displaced portions from the web to thus provide the web with perforations determining the permeability of the web; subdividing the perforated web into discrete uniting bands; and convoluting the discrete uniting bands around the groups in said first path.

2. The method of claim 1, wherein said removing step includes grinding the at least some displaced portions of the web in said second path.

3. The method of claim 1, wherein the web is advanced along the second path in a predetermined direction, said displacing step being carried out in a first portion of said second path and said removing step being carried out in a second portion of said second path downstream of said first portion as seen in said predetermined direction.

4. The method of claim 1, wherein said conveying step includes moving the groups along said first path in a predetermined direction and said convoluting step is carried out in a first portion of said first path, and further comprising the steps of monitoring at least one variable parameter of the groups in a second portion of said first path downstream of said first portion, generating signals denoting the at least one parameter of the groups, and utilizing said signals for regulation of said removing step so that the permeability of uniting bands varies as a function of variations of the at least one parameter.

5. The method of claim 4, wherein said utilizing step includes regulating the removing step so that the at least one variable parameter at least approximates a predetermined value.

6. Apparatus for making filter cigarettes wherein groups of plain cigarettes and filter rod sections are held in axial alignment by convoluted adhesive-carrying uniting bands, comprising means for conveying a series of successive groups along a first path; means for advancing a web of coherent uniting bands from a source along a second path; means for mechanically displacing selected portions of the advancing web relative to said second path; means for at least partially mechanically removing material from at least some of the displaced selected portions of the web to thus provide the web with perforations determining the permeability of the web; means for subdividing the perforated web into discrete uniting bands; and means for convoluting the discrete uniting bands around the groups in said first path.

7. The apparatus of claim 6, wherein said displacing means includes a rotary displacing member having a surface adjacent a predetermined portion of said second path and projections extending from said surface and into the web in said predetermined portion of said second path.

8. The apparatus of claim 7, wherein said surface is a peripheral surface of said rotary displacing member and said projections together form a predetermined pattern of web displacing projections on said peripheral surface.

9. The apparatus of claim 7, wherein said displacing means further comprises means for biasing the web against said projections, said rotary displacing member and said biasing means being disposed at opposite sides of said second path.

10. The apparatus of claim 9, wherein said biasing means comprises a second rotary member having a resilient web-contacting radially outer portion.

11. The apparatus of claim 6, wherein said removing means comprises a grinding device.

12. The apparatus of claim 11, wherein said advancing means includes means for moving the web along said second path in a predetermined direction, said displacing means being adjacent a first portion of said second path and said removing means being adjacent a second portion of said second path downstream of said first portion as seen in said predetermined direction, said grinding device including a rotary material removing tool which contacts at least said at least some displaced selected portions of the web in said second portion of said second path.

13. The apparatus of claim 6, wherein said removing means is adjustable and further comprising means for adjusting said removing means and the web in said second path relative to each other to thus select the extent of material removal from said at least some displaced selected portions of the web.

14. The apparatus of claim 13, wherein said adjusting means includes signal processing means.

15. The apparatus of claim 13, wherein said conveying means comprises means for moving the groups along said first path in a predetermined direction past and beyond said convoluting means, and further comprising means for monitoring at least one variable parameter of the groups downstream of said convoluting means and for generating signals denoting the monitored parameter, and means for influencing said adjusting means in response to said signals.

16. The apparatus of claim 15, wherein said influencing means includes means for maintaining the at least one variable parameter at least close to a predetermined value by way of said adjusting means.

17. The apparatus of claim 16, wherein said removing means includes a material removing tool and said advancing means includes means for looping the web around said tool to a variable extent to thus determine the extent of material removal from said at least some displaced selected portions of the web.

18. The apparatus of claim 17, further comprising means for adjusting said looping means.

19. The apparatus of claim 18, wherein said looping means comprises an adjustable roller and said adjusting means includes means for moving at least one of said roller and said tool relative to the other of said roller and said tool, the web being trained over said roller.

20. The apparatus of claim 19, wherein said adjusting means includes means for moving said roller relative to said tool to thus vary the area of contact between the web and said tool.

21. The apparatus of claim 6, wherein said removing means includes adjustable means for varying the tension of the web in said second path, means for monitoring the tension of the web in said second path, and means for adjusting said tension varying means when the monitored tension departs from a predetermined value.

22. The apparatus of claim 21, wherein said tension varying means includes a rotary member having a peripheral web-engaging surface and said adjusting means includes means for varying the rotational speed of said rotary member.

23. The apparatus of claim 6, further comprising means for evacuating the material being removed from said at least some displaced selected portions of the web.

24. The apparatus of claim 23, wherein said evacuating means includes a fluid-operated evacuating device.

25. A method of making filter cigarettes wherein groups of plain cigarettes and filter rod sections are held in axial alignment by convoluted adhesive-carrying uniting bands, comprising the steps of conveying a series of successive groups along a first path including moving the groups along said first path in a predetermined direction; advancing a web of coherent uniting bands from a source along a second path; displacing selected portions of the web and at least partially removing at least some of the displaced portions to thus provide the web with perforations determining the permeability of the web; subdividing the perforated web into discrete uniting bands; convoluting the discrete uniting bands around the groups in a first portion of said first path; monitoring at least one variable parameter of the groups in a second portion of said first path downstream of said first portion; generating signals denoting the at least one parameter of the groups; and utilizing said signals for automatic regulation of said removing step so that the permeability of uniting bands varies as a function of variations of the at least one parameter.

26. Apparatus for making filter cigarettes wherein groups of plain cigarettes and filter rod sections are held in axial alignment by convoluted adhesive-carrying uniting bands, comprising means for conveying a series of successive groups along a first path; means for advancing a web of coherent uniting bands from a source along a second path; means for displacing selected portions of the advancing web relative to said second path; means for at least partially removing material from at least some of the displaced selected portions to thus provide the web with perforations determining the permeability of the web; means for subdividing the perforated web into discrete uniting bands; means for convoluting the discrete uniting bands around the groups in said first path, said conveying means comprising means for moving the groups along said first path in a predetermined direction past and beyond said convoluting means; means for adjusting at least one of said removing means and the web in said second path relative to the other of said removing means and the web to thus select the extent of material removal from said at least some displaced selected portions; means for monitoring at least one variable parameter of at least one of (a) the groups downstream of said convoluting means and (b) the perforated web and for generating signals denoting the monitored parameter; and means for influencing said adjusting means in response to said signals.

27. Apparatus for making filter cigarettes wherein groups of plain cigarettes and filter rod sections are held in axial alignment by convoluted adhesive-carrying uniting bands, comprising means for conveying a series of successive groups along a first path; means for advancing a web of coherent uniting bands from a source along a second path; means for displacing selected portions of the advancing web relative to said second path; means for at least partially removing material from at least some of the displaced selected portions to thus provide the web with perforations determining the permeability of the web, including adjustable means for varying the tension of the web in said second path, means for monitoring the tension of the web in said second path, and means for automatically adjusting said tension varying means when the monitored tension departs from a predetermined value; means for subdividing the perforated web into discrete uniting bands; and means for convoluting the discrete uniting bands around the groups in said first path.

* * * * *